US010408388B1

(12) United States Patent
Chartrand

(10) Patent No.: US 10,408,388 B1
(45) Date of Patent: Sep. 10, 2019

(54) LED LIGHT TUBE ADAPTER KIT FOR STRIP LIGHTS

(71) Applicant: Jean-Claude Chartrand, London (CA)

(72) Inventor: Jean-Claude Chartrand, London (CA)

( * ) Notice: Subject to any disclaimer, the term of this patent is extended or adjusted under 35 U.S.C. 154(b) by 144 days.

(21) Appl. No.: 15/422,072

(22) Filed: Feb. 1, 2017

Related U.S. Application Data

(60) Provisional application No. 62/289,377, filed on Feb. 1, 2016.

(51) Int. Cl.

| | |
|---|---|
| ***F21V 19/00*** | (2006.01) |
| ***F21K 9/275*** | (2016.01) |
| ***F21V 23/06*** | (2006.01) |
| ***F21V 17/10*** | (2006.01) |
| ***F21V 23/00*** | (2015.01) |
| ***F21V 15/01*** | (2006.01) |
| ***F21K 9/278*** | (2016.01) |
| *F21Y 115/10* | (2016.01) |
| *F21Y 103/10* | (2016.01) |

(52) U.S. Cl.
CPC ..... *F21K 9/275* (2016.08); *F21K 9/278* (2016.08); *F21V 15/01* (2013.01); *F21V 17/10* (2013.01); *F21V 23/001* (2013.01); *F21V 23/003* (2013.01); *F21V 23/06* (2013.01); *F21Y 2103/10* (2016.08); *F21Y 2115/10* (2016.08)

(58) Field of Classification Search
CPC ..... F21K 9/275; F21K 9/278; F21V 15/01; F21V 17/10; F21V 23/001; F21V 23/003; F21V 23/06
USPC ..... 362/217.1
See application file for complete search history.

(56) References Cited

U.S. PATENT DOCUMENTS

| | | | |
|---|---|---|---|
| 6,739,734 | B1 | 5/2004 | Hulgan |
| 2007/0228999 | A1 | 10/2007 | Kit |
| 2010/0148673 | A1 | 6/2010 | Stewart et al. |
| 2011/0084608 | A1 | 4/2011 | Lin et al. |
| 2011/0121756 | A1 | 5/2011 | Thomas et al. |
| 2012/0113628 | A1 | 5/2012 | Burrow et al. |
| 2012/0161666 | A1 | 6/2012 | Antony et al. |
| 2013/0155670 | A1 | 6/2013 | Handsaker |

*Primary Examiner* — Elmito Breval
(74) *Attorney, Agent, or Firm* — Cramer Patent & Design, PLLC; Aaron R. Cramer

(57) ABSTRACT

A strip light tube adapter kit for converting fluorescent strip lighting to use LED light tubes is provided. The strip adapter kit includes a light tube having electrical connector prongs at a connector end, a strip lighting fixture, a non-powered connector near a first end of the light tube mechanically connecting the light tube to the strip lighting fixture, and an AC line powered lower housing having an attached tombstone fixture with a slot for receiving the connector prongs. The lower housing is mechanically attached to the strip light fixture and the tombstone fixture includes first and second connectors for electrically coupling the connector prongs to AC line power.

18 Claims, 8 Drawing Sheets

LED LIGHT TUBE ADAPTER KIT FOR STRIP LIGHTS

RELATED APPLICATIONS

The present invention is a continuation-in-part of, was first described in and claims the benefit of U.S. Provisional Application No. 62/289,377 filed Feb. 1, 2016, the entire disclosures of which are incorporated herein by reference.

FIELD OF THE INVENTION

The present invention relates to converting florescent tube strip lights to use LED (light-emitting diode) light sources.

BACKGROUND OF THE INVENTION

Concerns over the limited supply of fossil fuels have generated a great deal of research and engineering work in the area of alternative fuel and energy sources. Additionally, air pollution from the combustion of fossil fuels is another area of great interest. The concerns related to fossil fuels are related to many of the things that we do, from driving automobiles to recycling consumer products.

One (1) area that has received particular attention is that of reducing energy consumption used by illumination sources. Fluorescent strip light fixtures have been the mainstay of lighting in offices, stores, schools, and similar locations for many years. A fluorescent strip light fixture is typically a long, rectangular light fixture that fits into a ceiling grid. Fluorescent strip light fixtures are often surface mounted boxes but they also may be implemented recessed into the ceiling grid. While fluorescent strip light fixtures were originally designed for use with standard fluorescent lamps their widespread acceptance, modular benefits, low cost and ease of installing and maintaining have led them to be used with integral LED sources. While fluorescent strip light fixtures represent a major improvement over incandescent lamps they cannot compete with high efficiency LED lighting.

While LED lighting is highly energy efficient the cost of replacing existing light fixtures with LED light fixtures has been so high that many users simply put up with the inefficiencies of fluorescent lamps. Recently some manufacturers and suppliers have responded with LED retrofit kits. While such retrofit kits can be beneficial they are typically difficult and time consuming to install and usually do not afford the user with the ability to increase or decrease the number of light tubes to compensate for the increased efficiency of LED lamps.

Accordingly, there exists a need for a device by which fluorescent lamps in existing fluorescent strip light fixtures can be easily upgraded to LED-style lighting strip light fixtures at low cost.

SUMMARY OF THE INVENTION

The principles of the present invention provide for a device that enables low cost, easy replacement of fluorescent lamps in existing strip light fixture with LED-style lighting.

An adapter kit that is in accord with the present invention includes a light tube having electrical connector prongs at a connector end, a strip light fixture, a non-powered connector near a first end of the light tube mechanically connecting the light tube to the strip light fixture and an AC line powered lower housing having an attached tombstone fixture with a slot for receiving the connector prongs. The lower housing mechanically is attached to the strip light fixture and the tombstone fixture includes first and second connectors for electrically coupling the connector prongs to AC line power.

The non-powered connector may be a tombstone fixture or it may be a retention clip, preferably "U"-shaped. Also included may be HOT and NEUTRAL line conductors for supplying HOT and NEUTRAL line voltage to the lower housing. The strip light adapter kit might further include power connectors for connecting to the HOT and NEUTRAL line conductors while the lower housing may supply HOT and NEUTRAL line voltages to the first and second connectors using a power channel having a first power conductor and a second power conductor.

The tombstone fixture beneficially includes a base structure, a front housing having the opening and the slot such that the slot allows the connector prongs to pass to the opening, and a rear housing that is attached to the front housing. Also included would be a rotatable retention element at the opening and which is held captive between the front and rear housings. The rotatable retention element for retaining the connector prongs such that the connector end is mechanically supported. The first connector may be a HOT electrical contact disposed between the front and rear housings while the second connector may be a NEUTRAL electrical contact disposed between the front and rear housings. The rotatable retention element should be capable of traveling in an arcuate path to provide electrical communication between the conductive prongs and the first connector and the second connector. The first connector might be a contact spring and the front housing and the rear housing may be fastened together by a retention clip.

Beneficially the base structure includes a reinforcing grid. That reinforcing grid can then provide electrical isolation between the first power conductor and the second power conductor. A protective cover is beneficially disposed over the first power conductor and the second power conductor. The lower housing preferably includes a fastener structure for attaching the tombstone fixture. That fastener structure should have a retention channel that mates with an outer cap clip and with an inner cap clip of the protective cover which should snaps into the retention channel while the protective cover extends over the base structure. The light tube could be an LED light tube.

An LED light tube adapter kit that is in accord with the present invention includes an LED light tube having electrical connector prongs at a connector end, a strip light fixture, a non-powered connector near a first end of the light tube mechanically connecting the LED light tube to the strip light fixture, and an AC line powered lower housing having an attached tombstone fixture with a slot and an opening for receiving the connector prongs. The lower housing is mechanically attached to the strip light fixture and the tombstone fixture includes first and second connectors for electrically coupling the connector prongs to the AC line power.

The non-powered connector may be a tombstone fixture or a retention clip, beneficially "U"-shaped. In practice the tombstone fixture will include a base structure, a front housing having the opening and the slot such that the slot allows the connector prongs to pass to the opening, a rear housing that is attached to the front housing and a rotatable retention element at the opening and which is held captive between the front and rear housings. The rotatable retention element is for retaining the connector prongs such that the connector end is mechanically supported. The first connector should be a HOT electrical contact which is disposed between the front and rear housings and the second connector should be a NEUTRAL electrical contact that is disposed between the front and rear housings. The rotatable retention element is capable of traveling in an arcuate path to provide electrical communication between the conductive prongs and the first connector and the second connector.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
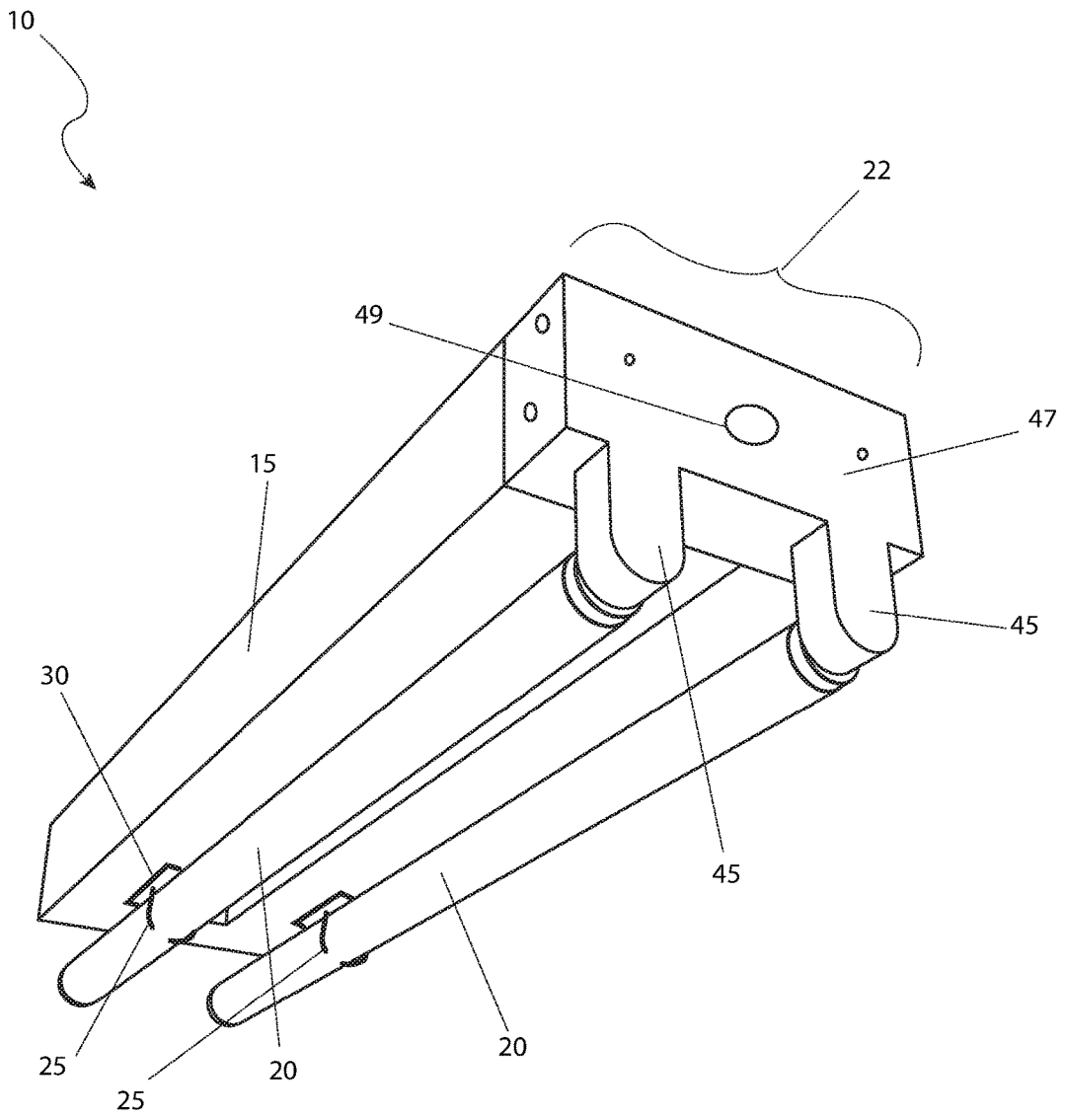
FIG. 1 is an isometric view of an LED light tube adapter kit 10 for fluorescent strip light fixtures which is in accord with a preferred embodiment of the present invention and which is installed in an existing fluorescent strip light fixture 15.

10 adapter kit
15 fluorescent strip light fixture
20 LED light tube
22 adapter unit
25 "U"-shaped clip
30 non-powered adjustment clip
40 powered end
45 tombstone fixture
47 lower housing
49 wiring access sleeve
85 base structure
90 front housing
95 rear housing
100 rotatable retention element
105 retention clip
110 upper entry slot
115 movable slot
120 first travel path "$t_1$"
125 first contact spring
126 second contact spring
130 first conductive contact
135 reinforcing grid
140 second conductive contact
145 interior conductor
150 lower power rail
155 upper protective cover
160 lower retention channel
165 outer snap clip area
170 inner snap clip area
175 power channel
180 first power conductor
185 second power conductor
190 cap area
195 outer cap clip
200 inner cap clip
201 first power jumper wire
202 second power jumper wire
205 conductive prong
300 intermediate terminal
305 jumper wire
310 joining terminal

DETAILED DESCRIPTION OF THE PREFERRED EMBODIMENT

The preferred embodiment of the present invention is depicted in FIGS. 1 through 6. However, the invention is not limited to the specifically described embodiment. A person skilled in the art will appreciate that many other embodiments of the invention are possible without deviating from the basic concept of the invention. Any such work around will also fall under the scope of this invention.

In the figures like numbers refer to like elements throughout. Additionally, the terms "a" and "an" as used herein do not denote a limitation of quantity, but rather denote the presence of at least one (1) of the referenced items.

Refer now to FIG. 1 for an isometric view of a LED light tube adapter kit 10 for a fluorescent strip fixture (hereinafter adapter kit 10) that is installed in an existing fluorescent strip fixture 15 and which is in accord with a preferred embodiment of the present invention. The illustrated fluorescent strip fixture 15 is a conventional strip style fluorescent fixture such as those that would be used in areas such as a garage, shop, retail store, or the like. The illustrated fluorescent strip fixture 15 is depicted as a two lamp, four foot (4 ft.) long fixture. However other lengths of strip lights such as one foot (1 ft.), two foot (2 ft.), eight foot (8 ft.) or the like could also be utilized.

The adapter kit 10 is shown using two LED light tubes 20. However, in practice the number of LED light tubes 20 can vary from one (1) to six (6) or more. One (1) end of the existing fluorescent strip fixture 15 is replaced with an adapter unit 22 whose mechanical and electrical configuration is described in greater detail below. The adapter unit 22 includes an appropriate number of tombstone fixtures 45 for the particular application. The other end of the existing fluorescent light fixture 15 is left as provided by the manufacturer. However, all internal wiring, along with the existing tombstones are removed.

The LED light tubes 20 are provided with internal drivers that are capable of operating at the supplied AC line voltage and which are in mechanical and electrical contact with the tombstone fixtures 45. Each tombstone fixture 45 is in mechanical and electrical contact with a lower housing 47. Further information on the mechanical and electrical structures of the lower housing 47 is provided below. One (1) end of each of the LED light tubes 20 is held in place by a "U"-shaped clip 25 which is in mechanical contact with a non-powered adjustment clip 30. Alternately, existing tombstones at one end of the existing fluorescent strip fixture 15 can be used to support one (1) end of each of the LED light tubes 20. Incoming electrical power to the lower housing 47 and thus to the fluorescent strip light fixture 15 is provided via a wiring access sleeve 49.

Figure 2:
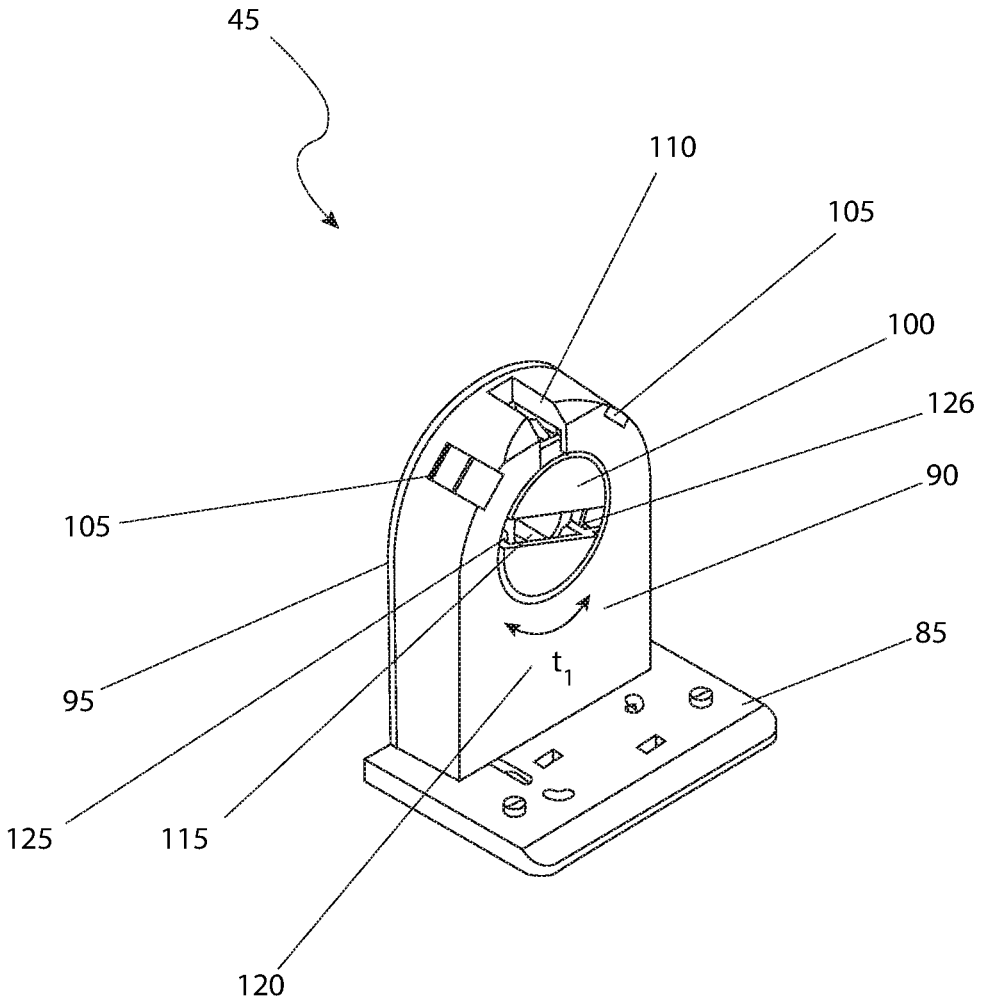
FIG. 2 is an isometric view of a tombstone fixture 45 that is part of the adapter kit 10 shown in FIG. 1.

Refer now to FIG. 2 for an isometric view of the tombstone fixtures 45. Each tombstone fixture 45 has a base structure 85 which connects to the lower housing 47 (as shown in FIG. 1). The tombstone fixtures 45 also include a front housing 90, a rear housing 95, and a rotatable retention element 100, all of which are envisioned to be manufactured of a non-conductive plastic.

The rotatable retention element 100 is held captive inside the front housing 90. The front housing 90 and the rear housing 95 are fastened together using a series of retention clips 105, of which only two (2) are shown due to illustrative limitations. An upper entry slot 110 allows for entry of the conductive prongs of the LED light tubes 20 (see FIG. 1) which align with a movable slot 115 of the rotatable retention element 100. Once the conductive prongs are fully inserted the LED light tubes 20 can be rotated along with the rotatable retention element 100 in compliance with a first travel path "$t_1$" 120. Once rotated approximately ninety degrees (90°) the conductive prongs of the LED light tubes 20 (see FIG. 1) engage a first contact spring 125 and a second contract spring 126 that are located inside the front housing 90. Further clarification of the first contact spring 125 and second contact spring 126 is provided below.

Figure 3A:
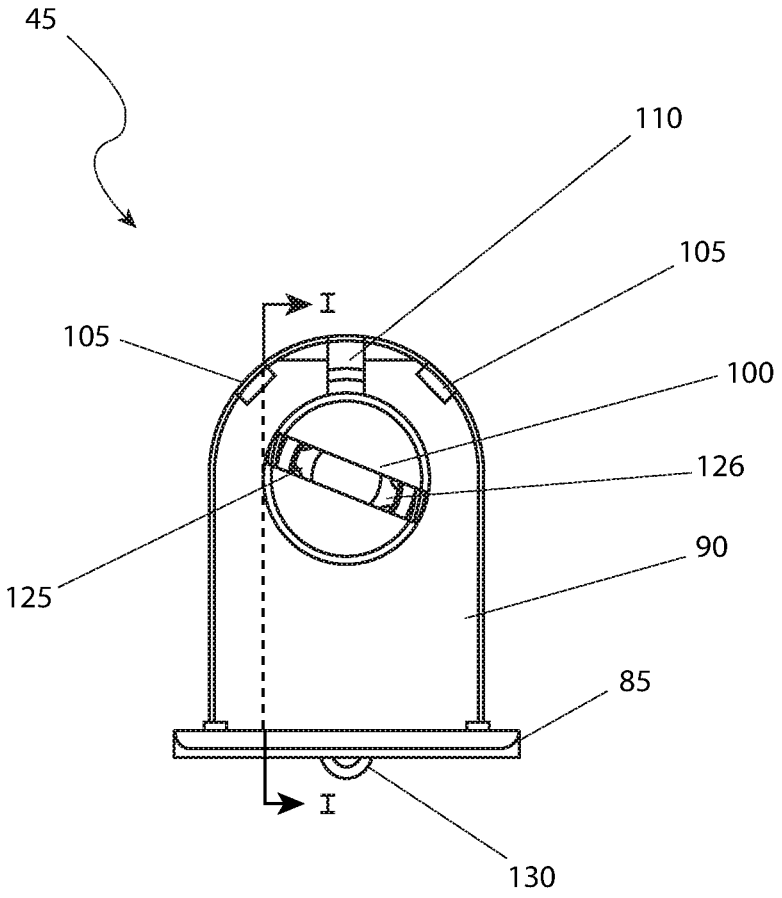
FIG. 3*a* is a front view of the tombstone fixture 45 shown in FIG. 2.

Refer now to FIG. 3*a* for a front view of the tombstone fixture 45. This view shows further details and helps clarify the positioning of the base structure 85, the front housing 90, the rotatable retention element 100, the retention clips 105, the upper entry slot 110, the first contact spring 125 and the second contact spring 126. Also visible is a first conductive contact 130 which is electrical contact with the first contact spring 125. The tombstone fixtures 45 are similar to "non-shunted" tombstone fixtures that are typically used with conventional fluorescent tubes.

Figure 3B:
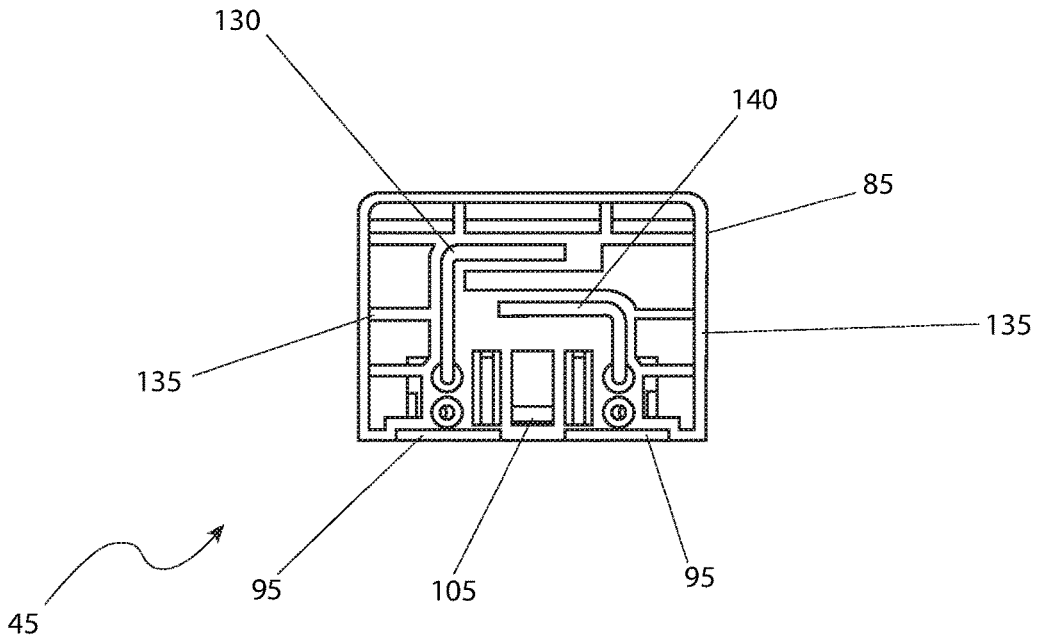
FIG. 3*b* is a bottom view of the tombstone fixture 45 shown in FIGS. 2 and 3*a;*

Refer next to FIG. 3*b* for a bottom view of the tombstone fixture 45. This view shows the base structure 85 as having a reinforcing grid 135 for structural integrity. An additional retention clip 105 is shown that helps retain the rear housing 95 in place. A second conductive contact 140 is shown near the first conductive contact 130. Both the first conductive contact 130 and the second conductive contact 140 are electrically isolated by the reinforcing grid. However, the first conductive contact 130 and the second conductive contact 140 are in respective electrical contact with the first contact spring 125 (see FIGS. 2 and 3*a*) and the second contact spring 126 (again, see FIGS. 2 and 3*a*).

Figure 3C:
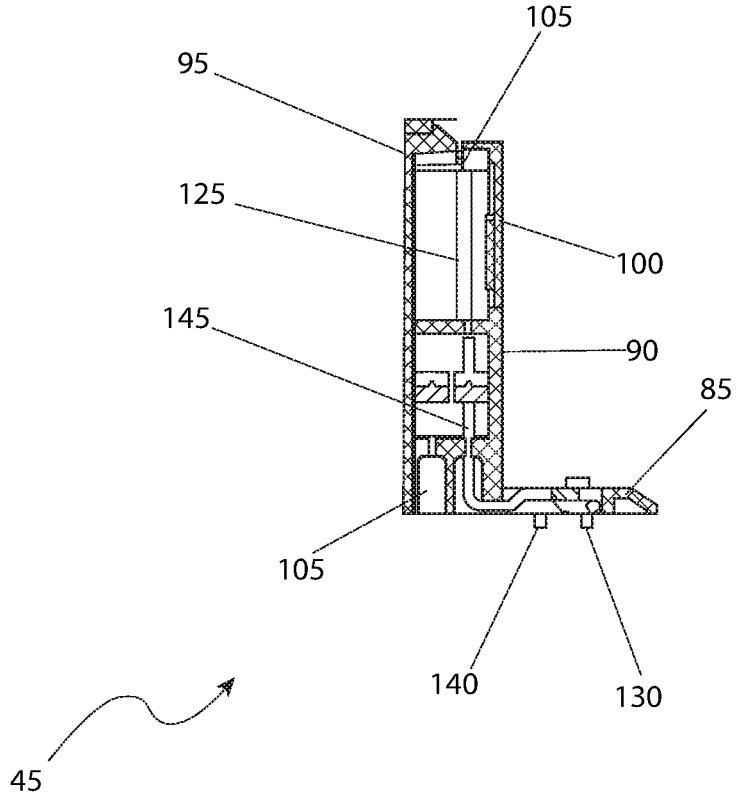
FIG. 3*c* is a sectional view of the tombstone fixture 45 taken along line I-I of FIG. 3*a;*

Refer now to FIG. 3*c* for a sectional view of the tombstone fixture 45 as seen along line I-I of FIG. 3*a*. That view shows the physical connections between the front housing 90 and the rear housing 95 and the captive assembly provided by the retention clips 105. That captive assembly holds the rotatable retention element 100 in a secure position as well as holding the first contact spring 125 and the second contact spring 126. The first conductive contact 130 and the second conductive contact 140 are visible on the lower portion of the base structure 85. Respective electrical connections between the first conductive contact 130 and the second conductive contact 140 to the first contact spring 125 and the second contact spring 126 (not visible due to illustrative limitations) is provided by two interior conductors 145 (only one of which is visible due to illustrative limitations). The first contact spring 125 and the second contact spring 126 are connected to HOT and NEUTRAL lines of an incoming AC power system respectively.

Figure 4:
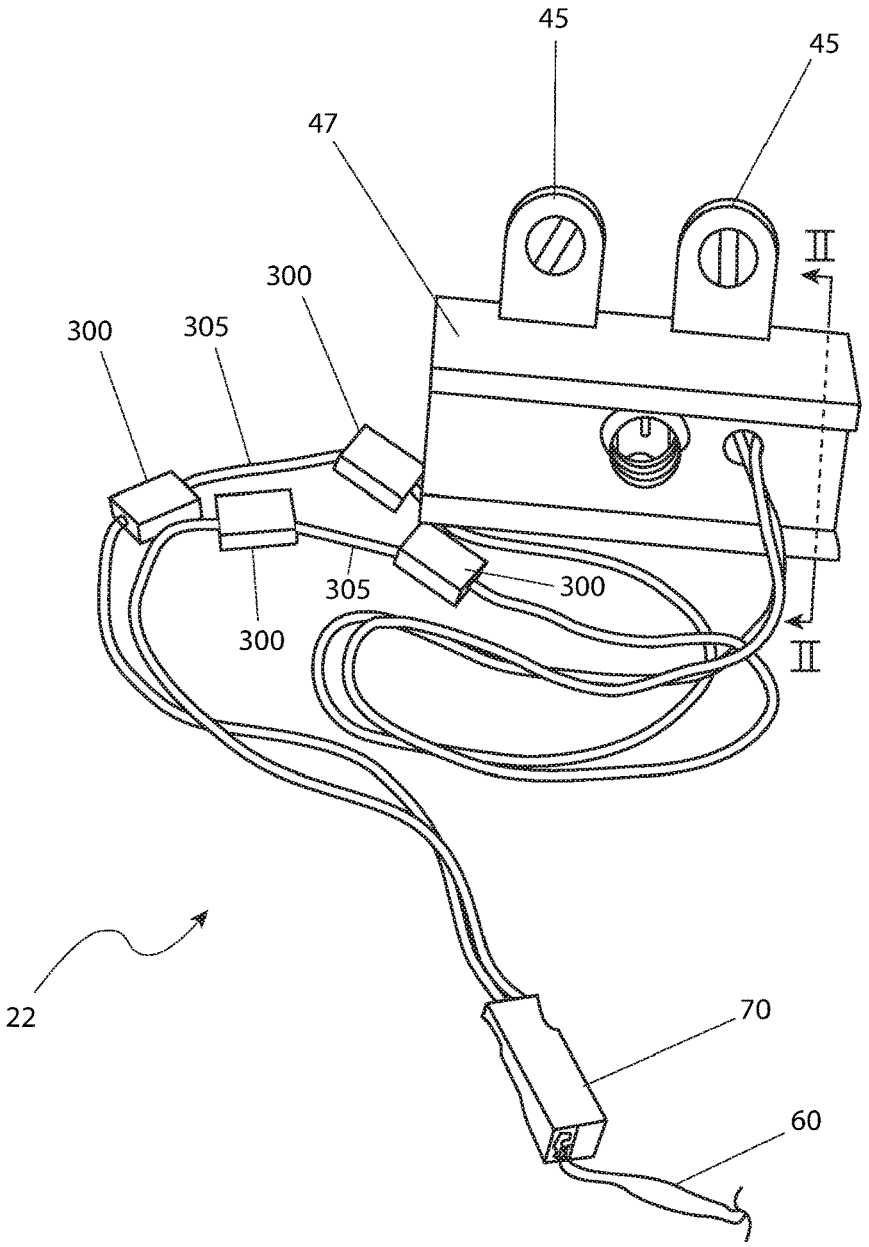
FIG. 4 is an isometric view of an adapter unit 22 that is part of the adapter kit 10 shown in FIG. 1.

Refer next to FIG. 4 for an isometric view of adapter units 22. The adapter end cap 47 is provided with input electrical line power, typically 120-VAC, 208-VAC, 277-VAC, 347-VAC, or the like via incoming power conductors 60. The incoming power conductors 60 will normally be part of a premise wiring system. The electrical connection between the adapter end cap 47 and the incoming power conductors 60 can be made by an electrical connector 70 such as a wire nut or a power supply terminal block as manufactured by the WAGO Corporation, such as but not limited to WAGO Luminaire Disconnect no. 873-902. Other terminals such as but not limited to WAGO Luminaire Disconnect no. 873-903 (three-pole), may utilize alternate conductors to selectively energize different LED light tubes 20 for achieve different levels of illumination as directed by occupancy sensors, multiple light switches, or the like to allow for reduced energy usage and associated cost savings. A series of intermediate terminals 300, such as but not limited to WAGO no. 224-101, with two (2) connectors on each wire with a jumper wire 305 in between could be used to connect alternate control devices such as remote control switches, remote control relays, or other future technologies related to Internet control, wireless control, or the like.

Figure 5:
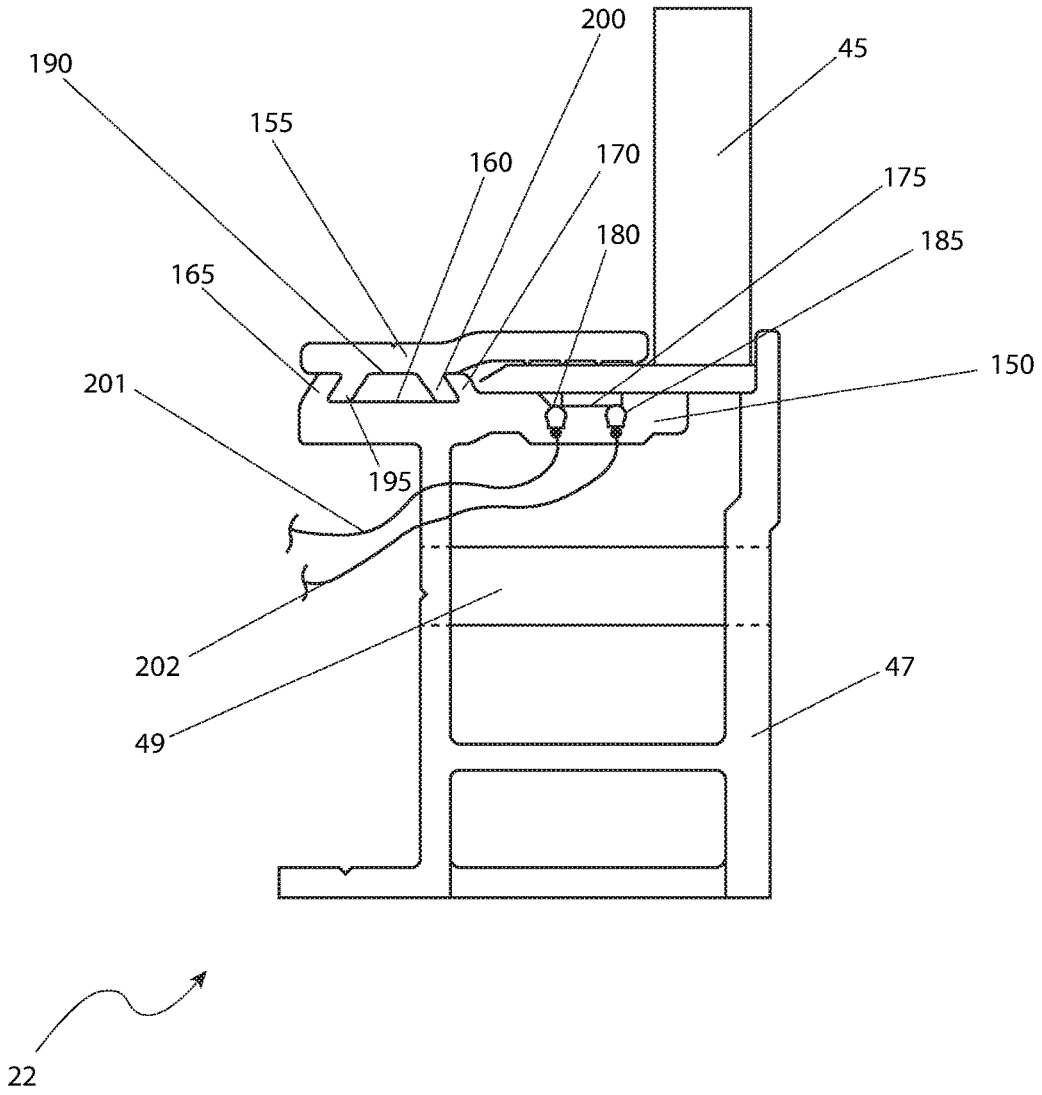
FIG. 5 is a sectional view of the adapter unit 22 taken along line II-II of FIG. 4 and, FIG. 6 is an electrical interconnection diagram of the adapter kit 10 shown in FIG. 1.

Refer now to FIG. 5 for a sectional view of the adapter unit 22 as seen along line II-II of FIG. 4. That sectional view illustrates the respective configurations of at least one (1) tombstone fixture 45, the lower housing 47, and the wiring access sleeve 49. The lower housing 47 consists of two (2) major components; a lower power rail 150 and an upper protective cover 155. In a completed installation, the upper protective cover 155 encompasses and encases the lower power rail 150 both for aesthetics as well as protection against electric shock. The lower power rail 150 consists of a lower retention channel 160 having an outer snap clip area 165 and an inner snap clip area 170 which occupy one half (½) of the lower power rail 150. The other half of the lower power rail 150 is occupied by a power channel 175 which contains a first power conductor 180 and a second power conductor 185. It is envisioned that the first power conductor 180 and the second power conductor 185 would be HOT and a NEUTRAL conductors respectively as provided by an AC power system.

The first power conductor 180 and the second power conductor 185 electrically mate with the second conductive contact 140 (see FIG. 3*c*) and the first conductive contact 130 (again, see FIG. 3*c*) respectively. It is envisioned that additional power conductors can be provided in a parallel path to the first power conductor 180 and the second power conductor 185 to provide other electrical functionality such as a system ground, reduced illumination switching, alternative color rating illumination, or the like. Such configurations may be useful to help comply with governmental laws for large institutions that that have to reduce their lighting system power usage during periods of high power demand Such additional functionality would require matching additional components on the part of the tombstone fixture 45.

The upper protective cover 155 provides insulating protection for the first power conductor 180 and the second power conductor 185 and also helps retain the tombstone fixture 45 to the lower housing 47. The upper protective cover 155 is held in mechanical contact with the lower retention channel 160 via a cap area 190 and by an outer cap clip 195 and an inner cap clip 200. The upper protective cover 155 extends over the base structure 85 of the tombstone fixture 45 to attach the tombstone fixture 47 to the lower housing 47. A first power jumper wire 201 and a second power jumper wire 202 are in electrical connection with the first power conductor 180 and the second power conductor 128 respectively, and are also in connection with the intermediate terminals shown in FIG. 4. The outer cap clip 195 engages the outer snap clip area 165. The inner cap clip 200 engages the inner snap clip area 170. Mechanical contact is maintained by friction which allows for removal/replacement for maintenance or for reconfiguring the LED light tubes 20. Additionally, the upper protective cover 155 serves as a lock for the tombstone fixture 45 to secure it for safety.

Figure 6:
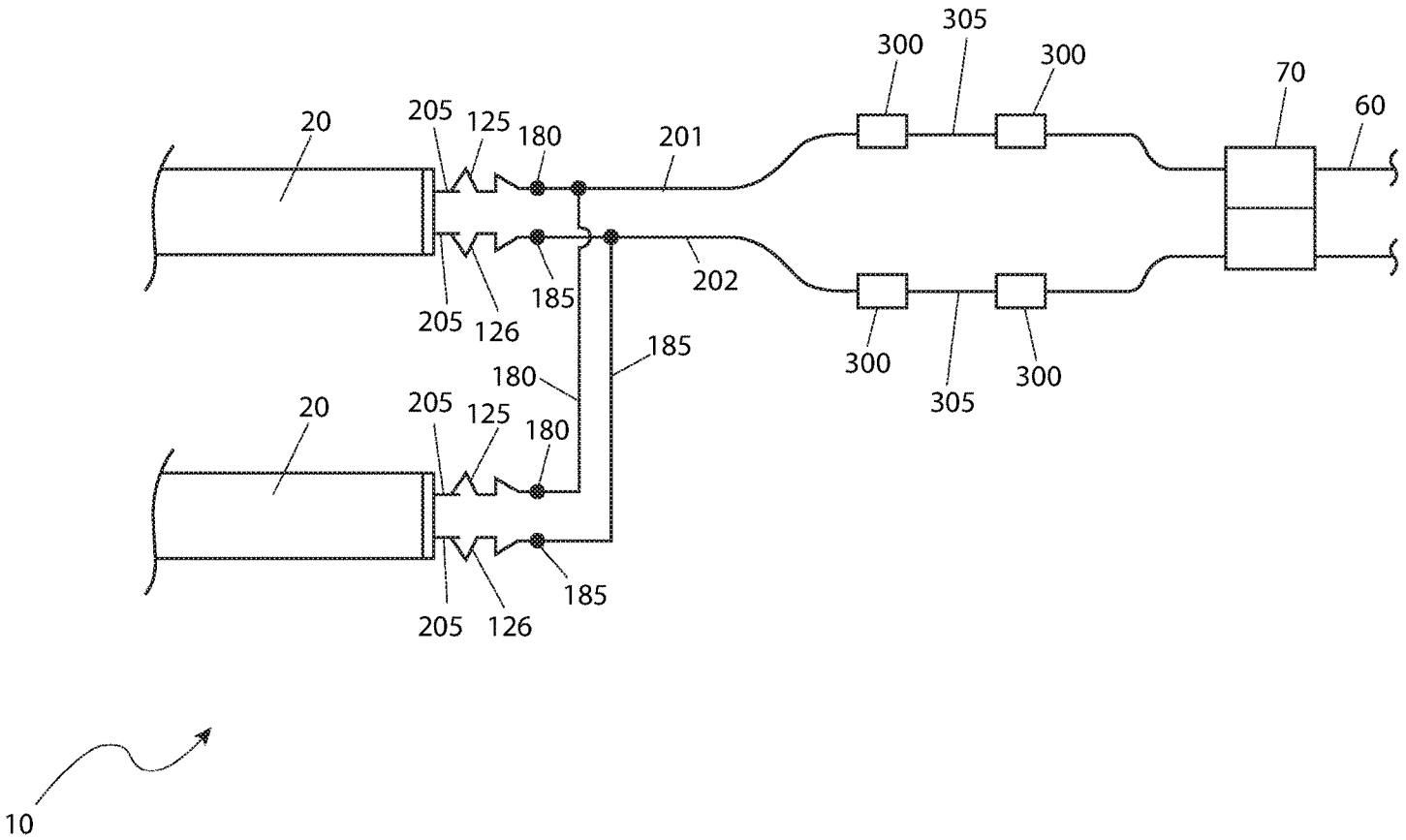

Refer now to FIG. 6 for an electrical interconnection diagram of the adapter kit 10. The LED light tubes 20 are provided with conductive prongs 205. The conductive prongs 205 mate to the HOT and NEUTRAL conductors of the AC power system. It should be noted that conductive prongs 205 are non-polarized due to the universal polarity of an AC power system. When inserted into the tombstone fixture 45 the conductive prongs 205 are in electrical contact with the first contact spring 125 and the second contact spring 126. Electrical path conductance is provided to the first power conductor 180 and the second power conductor 185 (and thus to the first contact spring 125 and the second contact spring 126) by mating them respectively with the first power jumper wire 201 and the second power jumper wire 202. Additional LED light tubes 20 are connected as shown in a parallel manner The electrical circuit then continues in a series conductive manner with the intermediate terminals 300 and the jumper wire 305 before final connection by the electrical connector 70 to the incoming power conductors 60.

The preferred embodiment of the present invention can be utilized by a qualified individual such as electrician, those skilled with working with hazardous AC voltages, or even a common homeowner who has experience installing or repairing common fluorescent light fixtures. Such installation could occur in a simple and effortless manner with little or no training.

It is envisioned that the adapter kit 10 would be constructed in general accordance with FIG. 1 through FIG. 6. Installation would progress once procurement has occurred. The user would begin by disconnecting power to the existing fluorescent strip fixture 15. Next, the fixture interior would be accessed. Existing components such as but not limited to fluorescent tubes, ballast(s), ballast covers, wiring, existing tombstones, and the like would be removed and discarded according to known and approved methods. Installation of the adapter kit 10 would continue by first installing the non-powered adjustment clip 30 and lower housing 47. A corresponding number of "U"-shaped clip 25 and tombstone fixture 45 would be installed upon the lower housing 47. Finally, the upper protective cover 155 would be applied. It should be noted that the number of removed fluorescent tubes does not need to match the number of installed LED light tubes 20. A higher or lower quantity of installed LED light tubes 20 could be installed depending on other factors such as desired light levels, energy savings, usage patterns, and the like.

Next, once they are disconnected from the existing ballast the user would connect the incoming power conductors 60 to the electrical connector 70. Any applicable control devices such as occupancy sensors, remote control devices or the like could be installed using the intermediate terminals 300. The appropriate number of LED light tubes 20 would be installed using the "U"-shaped clip 25 and the tombstone fixture 45 for mechanical retention and the tombstone fixture 45 for electrical connectivity. Finally, the operation of the adapter kit 10 would be verified by applying power and ensuring illumination.

It is envisioned that installation as described would be provided by a qualified individual such as an electrician, or could be accomplished by an end user such as a homeowner. It is also envisioned that the LED light tube adapter kit for fluorescent strip fixtures 10 would be approved by a listing agency such as UL and/or CSA.

The foregoing descriptions of a specific embodiment of the present invention have been presented for purposes of illustration and description. They are not intended to be exhaustive or to limit the invention to the precise forms disclosed, and obviously many modifications and variations are possible in light of the above teaching. The embodiment was chosen and described in order to best explain the principles of the invention and its practical application, to thereby enable others skilled in the art to best utilize the invention and various embodiments with various modifications as are suited to the particular use contemplated.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A strip light adapter kit, comprising:

a light tube having electrical connector prongs at a connector end;

a strip light fixture;

a non-powered connector near a first end of the light tube mechanically connecting said light tube to said strip light fixture;

an AC line powered lower housing having an attached tombstone fixture with a slot for receiving said connector prongs, said lower housing mechanically attached to said strip light fixture, and said tombstone fixture includes first and second connectors for electrically coupling said connector prongs to AC line power, a base structure, a front housing having an opening and said slot, wherein said slot allows said connector prongs to pass to said opening, a rear housing attached to said front housing, a rotatable retention element at said opening being held captive between said front and rear housings, said rotatable retention element for retaining said connector prongs such that said connector end is mechanically supported, said first connector being a HOT electrical contact disposed between said front and rear housings, said second connector being a NEUTRAL electrical contact disposed between said front and rear housings and wherein said rotatable retention element traveling in an arcuate path to provide electrical communication between said conductive prongs and said first connector and said second connector.

2. The strip light adapter kit of claim 1, wherein said non-powered connector is a tombstone fixture.

3. The strip light adapter kit of claim 1, wherein said non-powered connector is a retention clip.

4. The strip light adapter kit of claim 3 wherein said retention clip is "U" shaped.

5. The strip light adapter kit of claim 1, further comprising HOT and NEUTRAL line conductors for supplying HOT and NEUTRAL line voltage to said lower housing.

6. The strip light adapter kit of claim 5, further comprising power connectors for connecting to said HOT and NEUTRAL line conductors.

7. The strip light adapter kit of claim 6, wherein said lower housing is for supplying said HOT and NEUTRAL line voltages to said first and second connectors using a power channel having a first power conductor and a second power conductor.

8. The strip light adapter kit of claim 1, wherein said first connector is a contact spring.

9. The strip light adapter kit of claim 1, wherein said front housing and said rear housing are fastened together by a retention clip.

10. The strip light adapter kit of claim 1, wherein said base structure includes a reinforcing grid.

11. The strip light adapter kit of claim 10, wherein said reinforcing grid provides electrical isolation between said first power conductor and said second power conductor.

12. The strip light adapter kit of claim 10, further comprising a protective cover over said first power conductor and said second power conductor.

13. The strip light adapter kit of claim 12, wherein said lower housing including a fastener structure for attaching said tombstone fixture, said fastener structure including a retention channel that mates with an outer cap clip and with an inner cap clip of said protective cover and such that said protective cover snaps into the retention channel while said protective cover extends over the base structure.

14. The strip light adapter kit of claim 1 wherein said light tube is an LED light tube.

15. An LED light tube adapter kit, comprising:

an LED light tube having electrical connector prongs at a connector end;

a strip light fixture;

a non-powered connector near a first end of the light tube mechanically connecting said LED light tube to said strip light fixture;

an AC line powered lower housing having an attached tombstone fixture with a slot and an opening for receiving said connector prongs, said lower housing mechanically attached to said strip light fixture and said tombstone fixture including first and second connectors for electrically coupling said connector prongs to the AC line power, a front housing having an opening and said slot, wherein said slot allows said connector prongs to pass to said opening, a rear housing attached to said front housing, a rotatable retention element at said opening being held captive between said front and rear housings, said rotatable retention element for retaining said connector prongs such that said connector end is mechanically supported, said first connector being a HOT electrical contact disposed between said front and rear housings, said second connector being a NEUTRAL electrical contact disposed between said front and rear housings and wherein said rotatable retention element traveling in an arcuate path to provide electrical communication between said conductive prongs and said first connector and said second connector.

16. The LED light tube adapter kit according to claim 15, wherein said non-powered connector is a tombstone fixture.

17. The LED light tube adapter kit according to claim 16, wherein said non-powered connector is a retention clip.

18. The LED light tube adapter kit according to claim 17, wherein said retention clip is "U" shaped.

* * * * *